United States Patent [19]

Benson et al.

[11] 4,077,084

[45] Mar. 7, 1978

[54] APPARATUS AND METHOD FOR TREATING LINEAR MATERIAL

[75] Inventors: Gustav E. Benson, Edgewood; Everett W. Taylor, Cumberland, both of R.I.

[73] Assignee: Owens-Corning Fiberglas Corporation, Toledo, Ohio

[21] Appl. No.: 378,755

[22] Filed: Jul. 12, 1973

Related U.S. Application Data

[62] Division of Ser. No. 166,222, Jul. 26, 1971, Pat. No. 3,763,526, which is a division of Ser. No. 836,457, Jun. 25, 1969, abandoned.

[51] Int. Cl.[2] ..... B65H 54/86; D01H 11/00

[52] U.S. Cl. ..... 15/306 A; 15/300 R; 57/34.5; 57/56; 242/128; 242/147 A

[58] Field of Search ..... 57/34 B, 34.5, 59, 56, 57/156; 28/1.3, 1.4, 59, 55.7; 242/128, 147 A; 15/300 R, 306 R, 306 A, 345, 346, 347

[56] References Cited

U.S. PATENT DOCUMENTS

| | | | |
|---|---|---|---|
| 1,046,822 | 12/1912 | Madden | 242/147 A |
| 1,309,790 | 7/1919 | Walsh | 15/306 A |
| 2,302,790 | 11/1942 | Modigliani | 28/1.3 X |
| 2,488,934 | 11/1949 | Rayburn | 57/56 X |
| 2,630,280 | 3/1953 | Wedler | 242/128 |
| 2,646,941 | 7/1953 | Borges, Jr. | 242/147 A |
| 2,646,944 | 7/1953 | Heffelfinger | 242/147 A |
| 2,651,473 | 9/1953 | Siegenthaler | 15/306 A |
| 2,800,780 | 7/1957 | Chivington | 57/59 X |
| 3,014,356 | 12/1961 | Butler | 57/34 B |
| 3,328,946 | 7/1967 | Schumann et al. | 57/34 B UX |
| 3,482,387 | 12/1969 | Slack | 57/34.5 X |

FOREIGN PATENT DOCUMENTS

| | | | |
|---|---|---|---|
| 1,070,264 | 2/1954 | France | 242/147 A |
| 1,441,868 | 5/1966 | France | 28/59 |

*Primary Examiner*—John Petrakes
*Attorney, Agent, or Firm*—John W. Overman; Ronald C. Hudgens

[57] ABSTRACT

The apparatus and method of handling linear textile material to facilitate its processing including withdrawing the linear textile from a source and advancing it along a given path to a handling station; between the source and handling station applying the forces of a stream of fluid media in a direction opposing the movement of the textile material.

9 Claims, 4 Drawing Figures

APPARATUS AND METHOD FOR TREATING LINEAR MATERIAL

This application is a division of application Ser. No. 166,222, filed July 26, 1971, now U.S. Pat. No. 3,763,526, which is a division of application Ser. No. 836,457, filed June 25, 1969, and now abandoned.

BACKGROUND OF THE INVENTION

One may withdraw untwisted linear material from a wound package by "over end" removal or by "rolling off" the material from the package.

"Over end" removal of untwisted linear textile material from a wound package is often advantageous. The process of removing linear material in such a manner from a wound package is simpler. Because the package normally remains stationary during removal of linear material, apparatus does not need to manage either a rotating package mass or variations in the speed of the material leaving the package caused by package shape; both being inherent in "rolling off". Then too, one may remove the linear material from a wound package at higher speed.

Heretofore there has not been an effective way of processing untwisted multifilament linear material such as glass strand removed "over end" from a wound package. Removing untwisted multifilament linear material over an end of a wound package breaks individual filaments as the linear material leaves the package. These broken filaments tend to combine and form "fuzz ringers" or "fuzz bugs" on the linear material as it advances through subsequent textile processing apparatus, e.g. guides, tension devices and yarn treating apparatus. All too frequently these "fuzz ringers" impede the travel of the linear material through the processing apparatus to a point where forces along the material challenges the linear material beyond its tensile strength and the material breaks.

Moreover, untwisted linear textile material does not process as easily as twisted linear textile material. Processing is especially difficult in the case of glass strand, which upon removal from a forming package is somewhat flattened in cross section and includes filaments held together essentially only by the cohesive force of sizing material. Glass strands tend to "walk" across the peripheral surface of strand advancing rolls and their filaments tend to separate. "Walking" establishes overlying strand paths or "roll wrap", which breaks the strand.

There is a particular need for an effective way for "over end" removal of untwisted multifilament linear material in texturing operations, especially in the texturing of multifilament glass strand. Until now the disadvantages of "over end" removal outweighed its advantages. "Over end" removal of glass strands, as with other untwisted linear material, builds "fuzz bugs" from broken filaments. These "fuzz bugs" build on individual strands to the point where broken strands are excessive. Thus, texturing processes using untwisted multifilament linear material heretofore have not been economically feasible.

SUMMARY OF THE INVENTION

An object of the invention is an improved method and apparatus for processing linear material.

Another object of the invention is a method of handling textile material to facilitate its processing.

Another object of the invention is an improved method and apparatus for handling untwisted linear material being removed "over end" from a wound package to facilitate its processing.

Yet another object of the invention is an improved method and apparatus for processing untwisted multifilament linear material by advancing the material from a supply source into a fluid stream generally against the direction of fluid flow to treat the material and remove undesired matter from the material with the removed undesired matter being moved from the region of the fluid stream to a remote location.

Still another object of the invention is an improved method and apparatus for handling multifilament untwisted linear material in a process for fluid texturing the material.

Other objects and advantages will become apparent as the invention is hereafter described in more detail with reference made to the accompanying drawings.

DESCRIPTION OF THE PREFERRED EMBODIMENTS

While the apparatus and method of this invention is advantageous in processing untwisted multifilament linear material such as continuous or discontinuous filament glass strand, they may also find advantageous use in processing other untwisted multifilament linear material such as nylon, rayon, polyester or other organic or inorganic compositions. Additionally, one may employ the apparatus and method of the invention in processing composite multifilament linear material made of glass fibers and other fibers, e.g. resin fibers or polyethylene, tetrafluoroethylene, or possibly a polyamide. Also, one may at times find it advantageous to use the apparatus and method of the invention to process twisted linear textile material.

Figure 1:
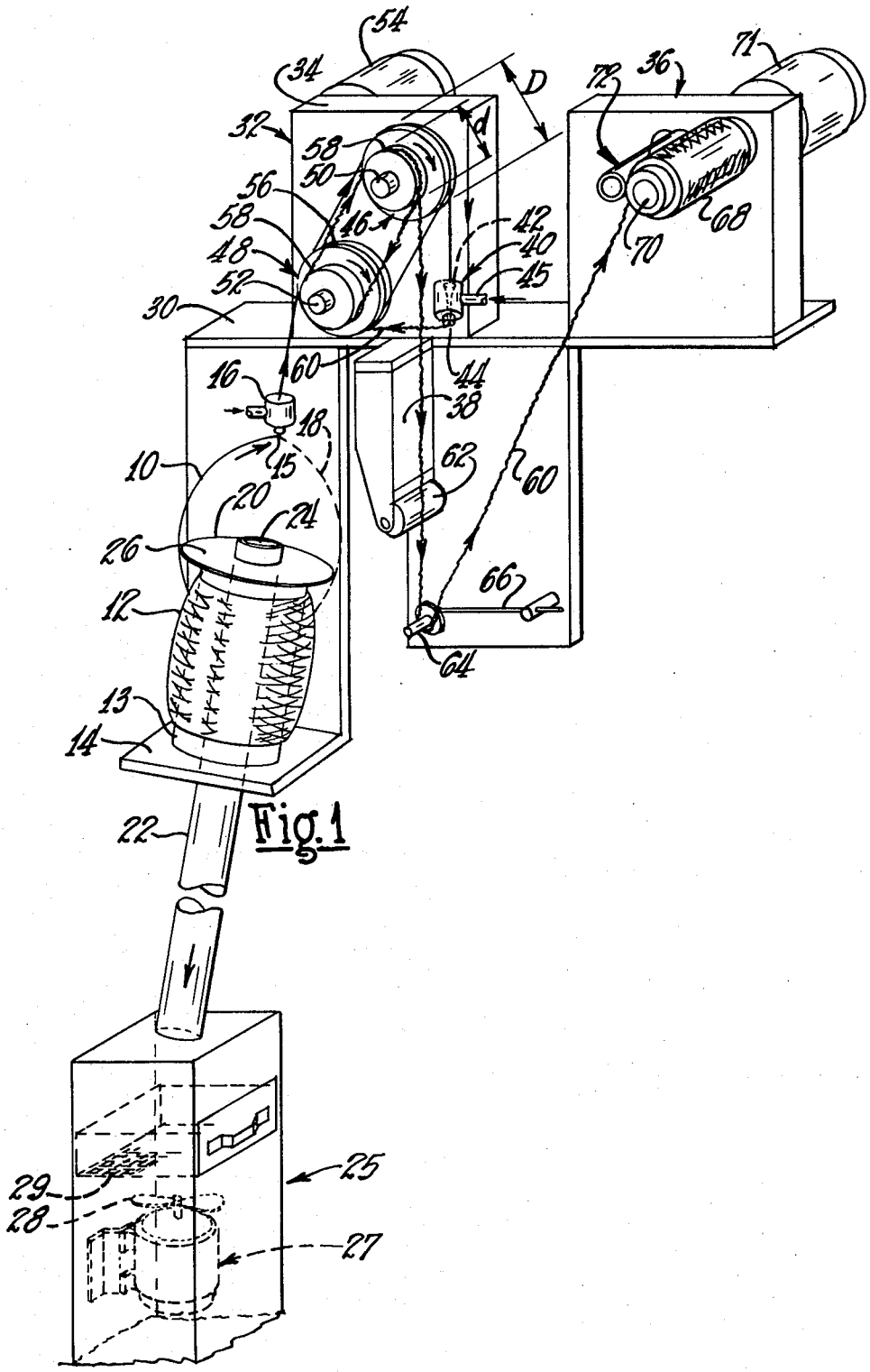
FIG. 1 is a perspective view of apparatus for bulking untwisted multifilament material such as glass strand that handles the material according to the principles of the invention.

FIG. 1 shows apparatus for texturing multifilament linear material where a continuous filament glass strand 10 leaves a supply package 12 wound on a tube 13 and receives a fluid handling treating or processing prior to traveling through a fluid texturing zone. The fluid treatment disturbs the strand's filaments to make the strand loosely integral and rounder in cross section and removes undesired matter from the moving strand.

As shown, an inclined platform 14 supports the supply package 12. The strand 10 leaves over the upper end of the supply package 12 and travels into a stream of air originating with means such as a fluid releasing strand treating device 16, which is located in spaced relation above the supply package 12. The strand 10 leaving the wound supply package 12 rotates about the axis of the tube 13, e.g. balloons, between the zone of strand departure on the package 12 and the fluid device 16. Dashed line 18 indicates ballooning. The device 16 issues a stream of fluid, e.g. air, from an outlet, denoted by reference numeral 15, into which the strand 10 enters. Thus the strand 10 moves against the direction of air flow as it enters the fluid outlet 15 of the strand treating device 16.

The support member or inclined plane 14 holds the package 12 and its tube 13 at an angle $\theta$ from the vertical. The angle $\theta$ is normally small, in the range of from 10° to 30°. While it is possible to operate the apparatus holding the pack 12 in a vertical or horizontal disposition, the inclined position is preferred. The inclined package position maintains the package strand layers or convolutions in substantially fixed location on the tube 13 without withdrawal of strand convolutions with the strand 10 as the apparatus withdraws it from the package 12.

A disc-like guide 20 resides across the upper end of the tube 13 over which the strand 10 leaves the package 12. The peripheral surface of the guide 20 provides a contact guide surface for the strand 10 as it balloons. Because the strand 10 is in contact with the peripheral surface of the disc or circular guide 20, it possesses a smooth and rounded peripheral surface. The disc 20 extends substantially normal to the axis of the tube 13 and usually has a diameter substantially equal to the largest cross section of the package 12. One may employ other guides providing a circular guide surface.

Figure 2:
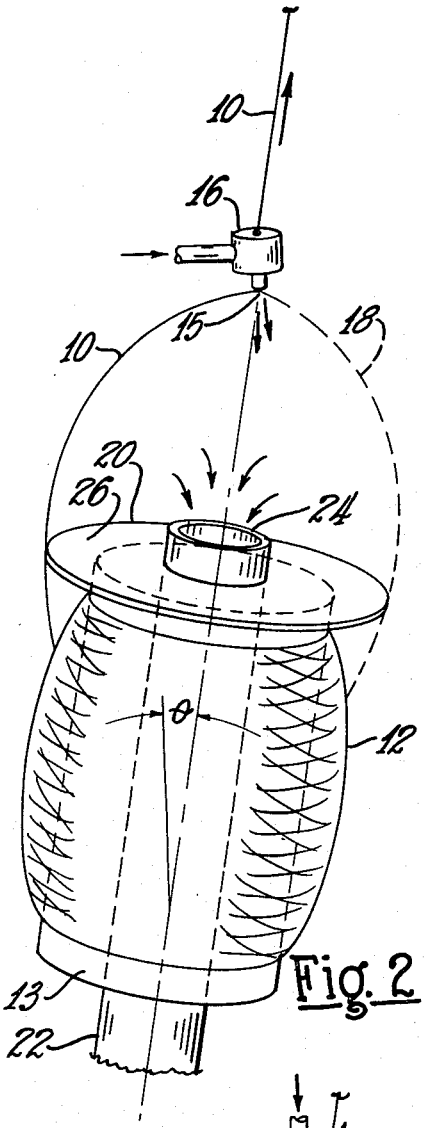
FIG. 2 is an enlarged perspective view of the supply package area of the apparatus shown in FIG. 1.

A fluid carrying means such as tube 22 extends axially of the wound supply package 12 through the tube 13. The tube 22 pierces the guide 20 and terminates at the end 24 adjacent to and above the disc's major surface 26 as shown in FIGS. 1 and 2.

The remote end of the fluid carrying tube 22 communicates with a zone of reduced fluid pressure. As shown in FIG. 1 the tube 22 connects to an air moving unit 25 having a fan 27. As the blades 28 of the fan 27 rotate, the fan draws air in the region of the entrance end 24 of the tube 22 into the unit 25. Located between the air entrance into the unit 25 and the fan 27 is a screen 29 through which air flows. The screen 29 functions as a collection zone and as shown, the screen 29 forms an element of a drawer, which provides easy access to the screen for cleaning.

A platform 30 located in spaced relation above the supply package 12 and strand treating device 16 supports a strand advancing arrangement 32 including housing 34, a collection means 36 and a liquid sizing applicator unit 38, which transfers liquid sizing to traveling multifilament linear material after apparatus textures it and prior to its collection on the collection means 36.

Associated with the yarn advancing arrangement 32 is a fluid jet 40, which has an entrance 42 and an exit 44. A fluid supply line 45 connects at a remote end with a source of fluid, e.g. air, under pressure and supplies such fluid under pressure to the interior of the fluid jet 40. While the construction of operation of the fluid jet 40 is generally known in the prior art, it has been useful to use jets such as disclosed in U.S. Pat. Nos. 3,328,863 and 3,402,446. As the air under pressure moves to escape from the exit 44 of the jet 40, it creates a zone of fluid agitation that textures multifilament material traveling through it.

The strand advancing arrangement 32 includes a pair of spaced apart cooperating double diameter feed and takeout rolls 46 and 48 that mount on shafts 50 and 52 respectively. These shafts rotatably mount on the housing 34. An electric motor 54 and a suitable drive arrangement rotate the rollers 46 and 48 together in the same direction. As shown in FIG. 1 the rollers move in a clockwise direction. Because it is important that the peripheral speed of each of the rollers 46 and 48 be the same at corresponding points on their peripheral surfaces, the rollers are normally identical in size. If the rollers are of different sizes, one must modify the drive arrangement to provide the same peripheral speed for each of the rollers.

Assuming that each of the rollers 46 and 48 have identical dimensions, each of these rollers includes a first cylinder section 56 having a diameter "D" and a second coaxially arranged cylinder section 58 having a diameter "*d*", which is smaller in dimension than the diameter "D". When the cylindrical section 56 of "D" diameter feeds the untextured strand 10 to the entrance 42 of the fluid jet 40 and the cylindrical sections 58 of "*d*" diameter withdraws the textured strand from the exit 44 of the fluid jet 40, the rolls lead the strand 10 to the fluid jet 40 at a faster linear speed than the textured or bulky-strand withdrawn from the fluid jet 40. Thus, an amount of "over feed" is made to the jet 40 and the ratio of the diameters "D"/"*d*" determines the "over feed".

With the strand advancing arrangement 32 located with the jet 40 as shown in FIG. 1 the feed and take-up rollers 46 and 48 advance the strand 10 from its supply package 12 through the fluid releasing strand treating device 16. The strand travels about and between the peripheral surfaces of the larger and first cylindrical sections 56 on each of the feed and take-up rollers 46 and 48 and thence into the entrance 42 of the fluid jet 40. The second cylindrical sections 58 at each of the rollers 46 and 48 withdraw the strand 10 from the exit 44 of the fluid jet 40 as textured strand 60. The apparatus locates the second cylindrical section 58 of the rollers 48 in relation to the outlet 44 of the fluid jet 40 so as to abruptly remove the textured strand 60 in a lateral direction from its path through the fluid jet 40. The strand winds around and between the peripheral surfaces of the cylindrical sections 56 and 58 a number of times sufficient to provide enough engagement with the surfaces to prevent slippage as the strand is being fed to and withdrawn from the fluid jet 40. In practice, it has been determined that approximately 4 – 6 times around and between each of the paths of the cylindrical sections 56 and 58 is sufficient to prevent strand slipping. Because the strand treating device 16 rounds the strand 10 and disturbs some of its filaments to interlock them and thereby loosely integrate the strand, the strand does not walk over the peripheral surfaces of the cylindrical sections 56 and 58.

The application of sizing to the textured strand 60 may be desirable in certain instances to partially assist in holding the filaments of the textured strand in place and further lock the filaments in their respective relationship with one another. Normally, it is desirable to employ a fluid sizing applicator such as applicator 38. After the textured strand 60 leaves the second section 58 of the feed and take-up roller 46, it advances downwardly across a sizing transfer roller 62 of the liquid sizing applicator 38. As the strand 60 travels across the surface of the roller 62 some sizing material on the roller surface transfers to the moving textured strand 60.

From the applicator roller 62 the textured yarn 60 advances to the collection means 36. As shown, the strand 60 moves from the roller 62 downwardly to a yarn guide roller 64 that is rotatably mounted on the free end of a pivotly mounted tension sensing arm 66. The tension sensing arm 66 comprises part of the collection means 36, which, as illustrated in FIG. 1, is a constant tension take-up device.

Constant tension take-up devices, which are commerically available from a number of manufacturers, include a tension sensing mechanism, such as the tension arm 66, which, through electrical-mechanical controls vary the speed of the yarn package winding on a mandrel in accordance with the variations in the tension of the linear material being wound. As shown, the textured strand 60 advances from the guide roller 64 to be wound as a package 68 on a mandrel 70. An electric motor 71 drives the mandrel. A strand traversing mechanism 72 reciprocates the textured strand 60 along the length of the package 68 as the strand 60 winds onto the package.

While over end removal of the strand 10 from the wound package 12 breaks filaments in the strand, alignment of the outlet 15 of the device 16 can reduce this filament breakage. The location of the device 16 controls the angle of strand removal from the package 12 and establishes ballooning characteristics of the strand 10 on its travel from the package 12 to the device 16. The fluid outlet 15 of the device 16, which in a sense functions as a guide eye or pigtail, should be in substantial alignment with the axis of the package 12 (tube 13) for satisfactory ballooning. If one locates the outlet laterally of such axis, the natural strand ballooning path is distorted and the strand rubs against the package surface on the side of the package away from the lateral offset of the outlet; such strand rubbing promotes broken filaments.

Further, the distance between the outlet 15 of the device 16 and the package 12 is important in reducing broken filaments during ballooning by establishing optimum ballooning conditions. The distance between the package 12 and the outlet 15 of the device 16 should be sufficiently close to provide a normal ballooning effect as indicated in the Figures. If the distance between the package 12 and the outlet of the device 16 is too great, the advancing strand 10 establishes standing waves with nodes and antinodes. Such standing waves in the moving and ballooning strand 10 are disruptive and promove broken filaments. If the package 12 and the outlet 15 of the device 16 are too close, the strand 10 will balloon outwardly too much. The angle of strand removal from the package 12 becomes too great and the result is greatly increased filament damage and breakage. A distance of from 6 to 7 inches from the end of the package 12 nearest the device 16 to the outlet of the device is normally sufficient to provide desirable ballooning for a package having a diameter of from 6.5 to 8 inches.

While the strand treating device 16 may be a simple fluid releasing devide such as a tube having air under pressure supplied to it, it may also be more complex. It has been useful to employ a fluid jet such as the fluid jet 40 as the device 16. Under such an arrangement it has been successful to use an air pressure of from 40 to 60 psig with a linear speed in the range of from 2500 to 3000 feet per minute supplied into the strand entrance (fluid outlet) 15.

When the apparatus and method of the invention uses a fluid jet such as fluid jet 40 as the strand treating device 16, a strand enters the jet's fluid outlet and exits the jet at what is normally the jet's strand or yarn entrance.

As the apparatus in operation withdraws the strand 10 "over end" from its source, the package 12, filaments break. The advancing strand 10 follows a given path, e.g. balloons outwardly of the entrance 24 of the tube 22, and travels to the air outlet 15 of the device 16. The strand 10 enters into the air stram moving through the device 16 from its air outlet.

In operation the device 16 treats the strand 10 in several ways. The forces of the air stream move in a direction opposing movement of the strand, the energy of the impinging air removing undersired matter such as broken filaments and directs the matter from the strand. Moreover, the air tends both to disturb some of the filaments to interlock or interengage themselves and to make a normally somewhat flattened strand rounder in cross section. Interengagement of the disturbed filaments makes a loosely united strand. Also, because the air opposes the movement of the advancing strand 10, tension is added to the strand between the device 16 and the strand advancing arrangement 32.

The tube 22 provides a region of reduced fluid pressure that pulls air in the vicinity of the entrance of end 24 into the tube 22. The flow of air into the end 24 of the tube 22 draws or sucks matter separated from the strand 10 by the air stream of the device 16 and released to the atmosphere. The matter travels into the tube 22 through the entrance 24 and is carried by the air to the tube's remote end into the unit 25 for collection on the screen 29. Air movement from the reduced pressure must be sufficiently strong to establish air flow conditions in the vicinity of the air outlet of the device 16 to control the matter yielded to the atmosphere by the air stream of the device 16 and have the air carry the matter into the tube 22 for removal from the treating zone.

As indicated in the FIGS. 1 and 2, the strand 10 can move away from the device 16 to the strand advancing arrangement 32 along a path divergent from the longitudinal axis of the device 16.

After the strand 10 leaves the fluid treating device 16, it travels to the texturing zone for bulking or texturing prior to collection in the form of the package 68 on the mandrel 70.

Figure 3:
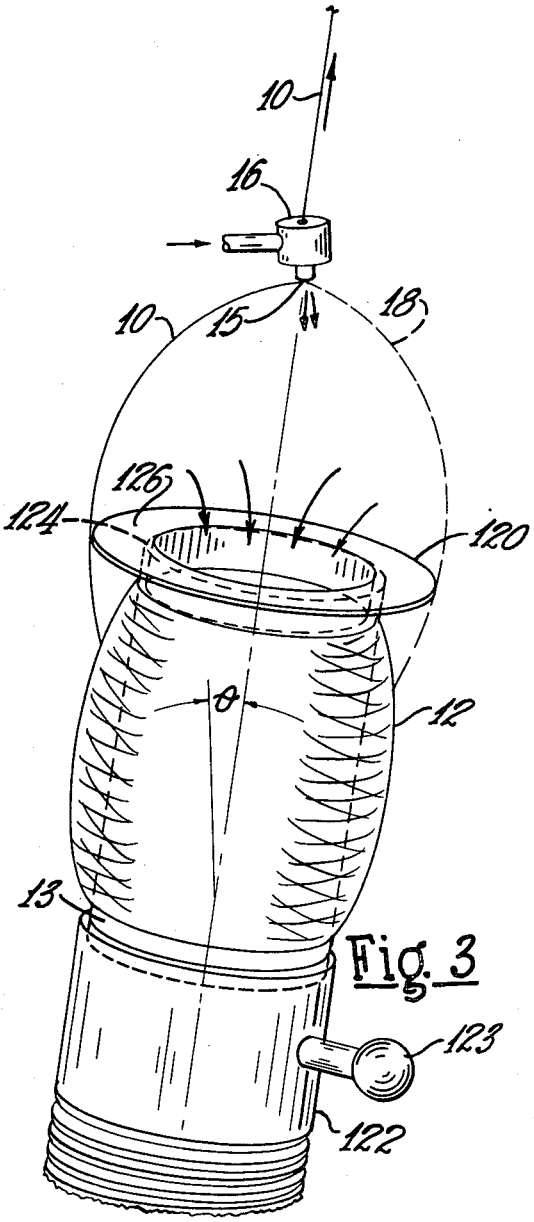
FIG. 3 is an enlarged perspective view of a modified supply package area for use with apparatus shown in FIG. 1.

FIG. 3 illustrates another arrangement for handling linear textile material such as the glass strand 10 to facilitate further processing of the strand. As in the arrangement shown in FIGS. 1 and 2 the glass strand 10 leaves the outer surface of the supply package 12, which is wound on the tube 13, and receives a fluid treatment or processing prior to traveling through a fluid texturing zone established by the fluid texturing nozzle 40. In FIG. 3 the package 12 and tube 13 remain inclined at an angle $\theta$ from the vertical. The apparatus withdraws the strand 10 along a determined path from the outer surface of the package 12 to means for supplying a stream of air such as the fluid strand treating device 16, which is located in spaced relation at one end and above the supply package 12. As the strand 10 leaves the package 12 over end, it rotates about the axis of the tube 13 as it unwinds from the package 12. As shown, the strand 10 balloons between the package 12 and the fluid device 16 as it travels over the upper end of the package 12 to the device 16. The dashed line 18 indicates ballooning.

The device 16 issues a stream of fluid, e.g. air, from the outlet 15 into which the strand 10 enters. Thus, the stream of air moves in a direction opposing the movement of the strand 10 along its path.

The arrangement shown in FIG. 3 fixes a disc-like guide 120 across the end of the tube 13 nearest the fluid device 16 and over which the strand 10 leaves the package 12. Its major surface 126, which is located away from the package 12, is flush with the end 124 of the tube 13. The peripheral surface of the guide 120 provides a circular guide surface for the advancing strand 10 as it balloons from the package 12 to the device 16. As with the guide 20 the guide 120 possesses a smooth and rounded peripheral surface and extends substantially normal to the axis of the tube 13. The inside diameter of the guide 120 is equal to the outside diameter of the tube 13, thus leaving the upper end of the tube 13 unobstructed.

A flexible elongated tubular member 122 connects to the other end of the tube 13. A ball joint member 123 on the tubular member can connect to an appropriate support means. The remote end of the fluid carrying tube 122 connects to a means for providing reduced air pressure such as the unit 25 shown in FIG. 1.

Because the end 124 of the tube 13 is totally unobstructed, operation of the means for providing reduced pressure draws air through the tube 13. Air moving into the entrance end 124 of the tube 13 draws into the tube matter removed from the traveling strand 10 at the fluid treatment zone of the device 16. Such matter collects on means such as screen 29 shown in FIG. 1.

While the outlet 15 of the device 16 is aligned with the axis of the tube 13 (package 12), the device 16 itself is inclined to the axis of the tube 13.

Figure 4:
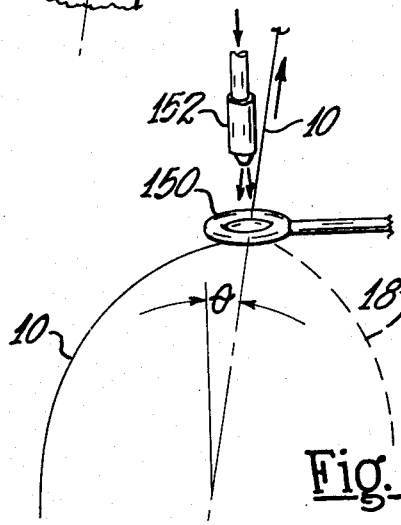
FIG. 4 is an enlarged view of another means for supplying a stream of air to advancing multifilament material, e.g. glass strand, according to the principles of the invention.

FIG. 4 illustrates another arrangement for handling linear material such as the strand 10 to facilitate its further processing. As shown in FIG. 4 the strand 10 advances from the package 12 to a pigtail 150 located in the same location as the outlet 15 to the nozzle 16 in FIGS. 1 - 3. A means for supplying a fluid stream such as an air nozzle 152 blasts a stream of air at the traveling strand 10 as it leaves the pigtail 150 on its way to a strand handling processing station, e.g. fluid texturing. The location and disposition of the nozzle 152 is such that the stream of air applies forces to the moving strand 10 in opposition to the strand's movement.

In operation the arrangement shown in FIG. 4 removes undersired matter from the traveling strand 10. The stream from the nozzle 152 yields the undersired matter to the atmosphere. As in the arrangements of FIGS. 1 - 3 one may move the air in the vicinity of the stream to remove the undesired matter from the traveling strand 10, e.g. drawing the matter to a collection zone.

We claim:

1. A method of processing multifilament linear textile material comprising:

withdrawing multifilament linear textile material from one end of a wound package of the textile material;

linearly advancing the linear textile material away from the package into an air outlet of a first passageway disposed so that such outlet generally faces the end of the package;

discharging an air stream from the outlet with sufficient energy to remove undesired matter from the advancing linear textile material, the stream yielding the undesired matter to the atmosphere; and drawing air in the vicinity of the stream away from the stream into a second passageway to move separated and undesired matter yielded to the atmosphere to a collection zone.

2. A method of processing glass strand comprising:

continuously withdrawing glass strand from the outer surface of a wound package having an axial passageway by advancing it over one end thereof;

advancing the glass strand to a nozzle passageway from which air escapes as a stream, the linear material moving against the direction of air flow;

separating undesired matter from the glass strand by the impinging air of the stream, the stream yielding the separated matter to the atmosphere; and continuously sucking air from the vicinity of the stream into the axial passageway to draw the separated matter away from the traveling strand.

3. The method recited in claim 2 where the glass strand balloons as it advances from the package to the air outlet of the nozzle.

4. Apparatus for handling linear textile material comprising:

a wound package of linear textile material;

means in spaced relation at one end of the package defining a passageway having an air discharge outlet generally facing the one end of the package;

means for supplying air under pressure to the passageway to discharge a stream of air from its air discharge outlet;

means for linearly withdrawing the linear textile material from the outer surface of the package and over the one end thereof into the air discharge outlet, the air supply means supplying air under sufficient pressure to discharge the stream from the outlet with sufficient energy to separate undesired matter from the linear material during its advancement in the stream; and means for drawing air away from the vicinity of the stream to remove the separated matter yielded to the atmosphere by the stream away from the textile material for collection.

5. Apparatus for processing glass strand comprising:

a wound package of glass strand, the package having an axial passageway;

means for supplying a stream of air, the means located in spaced relation at one end of the package;

means for drawing air into the end of the axial passageway nearest the means for supply of the stream of air; and means for advancing the glass strand over the end of the package nearest the means for supplying the stream of air through the stream of air, the stream of air opposing the movement of the glass strand and separating undesired matter from the strand, the separated matter being drawn into the axial passageway.

6. Apparatus for processing glass strand from a wound package having an axial passageway extending therethrough comprising:

means for drawing air into the axial passageway at one end;

a collection zone, the passageway being in communication with the collection zone;

an air nozzle spaced from the air entrance end of the passageway;

means for supplying air under pressure to the nozzle, air supplied to the nozzle being released as a stream from the nozzle's outlet, the outlet being in substantial alignment with the axial passageway; and means for advancing the strand through the nozzle from the outer surface of the wound package over the end of the package at which the air entrance end of the passageway is located, the traveling strand entering the nozzle through the nozzle's outlet against the direction of air flow in the stream, undesired matter removed from the traveling strand as it travels through the air stream being drawn from the outlet region into the axial passageway for accumulation at the collecting zone.

7. Apparatus for processing glass strand comprising:

a tube;

a package of glass strand wound on the tube;

support means for holding the package and the tube stationary;

means for drawing air into the tube at one end;

a collection zone, the interior of the tube being in communication with the collection zone;

an air nozzle spaced from the air entrance end of the tube;

means for supplying air under pressure to the nozzle, air supplied to the nozzle being released as a stream from the nozzle's outlet, the outlet of the nozzle generally facing towards the air entrance end of the tube and being in substantial alignment with the axis of the tube;

means for advancing the strand through the nozzle from the outer surface of the package, the strand traveling over the end of the package at which the air entrance end of the tube is located to enter the nozzle at the air outlet against the direction of air flow, the path of the advancing strand rotating about the air entrance end of the tube as it travels to the nozzle outlet, undesired matter being removed from the traveling strand as it advances through the air stream, the separated and undesired matter being drawn from the region of the outlet into the tube at its air entrance end for accumulation at the collection zone.

8. Apparatus recited in claim 7 further including a circular guide member with a diameter larger than the diameter of the tube located adjacent to and surrounding the entrance end of the tube, the circular guide member being substantially normal to the axis of the tube and the center of the circle defining the member being located on the axis of the tube.

9. Apparatus recited in claim 8 where the diameter of the circular guide member is substantially equal to the diameter of the wound package at the largest transverse section of the package.

* * * * *